US009416953B2

(12) United States Patent
Kim et al.

(10) Patent No.: US 9,416,953 B2
(45) Date of Patent: Aug. 16, 2016

(54) LED LIGHTING APPARATUS

(75) Inventors: Sung Min Kim, Seoul (KR); Kwang Jae Lee, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 144 days.

(21) Appl. No.: 14/113,126

(22) PCT Filed: Apr. 19, 2012

(86) PCT No.: PCT/KR2012/003016
§ 371 (c)(1),
(2), (4) Date: Jan. 8, 2014

(87) PCT Pub. No.: WO2012/144831
PCT Pub. Date: Oct. 26, 2012

(65) Prior Publication Data

US 2014/0112006 A1 Apr. 24, 2014

(30) Foreign Application Priority Data

Apr. 21, 2011 (KR) ..... 10-2011-0037237

(51) Int. Cl.

| | |
|---|---|
| ***F21V 29/02*** | (2006.01) |
| ***F21V 29/00*** | (2015.01) |
| ***F21K 99/00*** | (2016.01) |
| ***F21V 29/77*** | (2015.01) |
| *F21Y 101/02* | (2006.01) |

(52) U.S. Cl.
CPC ..... *F21V 29/22* (2013.01); *F21K 9/1355* (2013.01); *F21V 29/004* (2013.01); *F21V 29/773* (2015.01); *F21Y 2101/02* (2013.01)

(58) Field of Classification Search
CPC ..... F21V 29/22; F21V 29/773; F21V 29/004
USPC ..... 362/293, 373, 640
See application file for complete search history.

(56) References Cited

U.S. PATENT DOCUMENTS

| | | | | |
|---|---|---|---|---|
| 7,661,854 | B1 | 2/2010 | Yang et al. | |
| 8,783,937 | B2 * | 7/2014 | Steedly | 362/646 |
| 2004/0066142 | A1 | 4/2004 | Stimac et al. | |
| 2009/0296402 | A1 | 12/2009 | Chang et al. | |
| 2011/0057551 | A1 | 3/2011 | Lee et al. | |

(Continued)

FOREIGN PATENT DOCUMENTS

| | | | |
|---|---|---|---|
| CN | 201221693 | Y | 4/2009 |
| CN | 102022657 | A | 4/2011 |

(Continued)

OTHER PUBLICATIONS

International Search Report in International Application No. PCT/KR2012/003016, filed Apr. 19, 2012.

(Continued)

*Primary Examiner* — Anabel Ton
(74) *Attorney, Agent, or Firm* — Saliwanchik, Lloyd & Eisenschenk

(57) ABSTRACT

Provided is an LED lighting apparatus. The LED lighting apparatus include an LED, a socket part supplying a power into the LED, a heat sink body having one side on which the LED is mounted and the other side to which the socket part is coupled, and a heat sink pin disposed along a circumference of the heat sink body, the heat sink pin having one side extending downward from the heat sink body. The heat sink body may be modified in shape to reduce a weight and improve heat dissipation performance.

11 Claims, 5 Drawing Sheets

(56) References Cited

U.S. PATENT DOCUMENTS

| | | | | |
|---|---|---|---|---|
| 2012/0161628 | A1 | 6/2012 | Chang et al. | |
| 2012/0170262 | A1 | 7/2012 | Hoetzl et al. | |
| 2012/0223640 | A1* | 9/2012 | Koplow | 315/50 |
| 2014/0043810 | A1* | 2/2014 | Jo et al. | 362/235 |

FOREIGN PATENT DOCUMENTS

| | | | |
|---|---|---|---|
| DE | 10-2009-052930 | A1 | 3/2011 |
| EP | 2077415 | A1 | 7/2009 |
| EP | 2295854 | A1 | 3/2011 |
| JP | 2006-502561 | A | 1/2006 |
| KR | 10-0927114 | B1 | 11/2009 |
| KR | 10-2010-0124411 | A | 11/2010 |
| WO | WO-2008093978 | A1 | 8/2008 |
| WO | WO-2010/066841 | A1 | 6/2010 |

OTHER PUBLICATIONS

European Search Report in European Application No. 12773716.1, dated Dec. 11, 2014.

European Search Report dated Nov. 13, 2015 in European Application No. 12773716.1.

* cited by examiner

LED LIGHTING APPARATUS

CROSS-REFERENCE TO RELATED APPLICATIONS

This application is the U.S. national stage application of International Patent Application No. PCT/KR2012/003016, filed Apr. 19, 2012, which claims priority to Korean Application No. 10-2011-0037237, filed Apr. 21, 2011, the disclosures of each of which are incorporated herein by reference in their entirety.

TECHNICAL FIELD

The present disclosure relates to an LED lighting apparatus, and more particularly, to an LED lighting apparatus having an improved heat dissipation effect.

BACKGROUND ART

Generally, lighting apparatuses are being utilized as home lightings or other indoor and outdoor lightings using incandescent lamps, fluorescent lamps, or High brightness light emitting diodes (LEDs).

Among these, LED lighting apparatuses have low power consumption and semi-permanent life when compared to general incandescent lamps. Thus, the LED lighting apparatuses are being widely used.

An LED lighting apparatus according a related art includes a heat sink for effectively dissipating heat generated in an LED. However, the heat sink has a structure which does not effectively dissipate heat generated in a power supply unit (PSU).

As a result, a PSU's life may be reduced, or a lift of the LED lighting apparatus may be reduced by the heat generated in the PSU.

DISCLOSURE OF INVENTION

Technical Problem

Embodiments provide an LED lighting apparatus which can effectively dissipate heat generated in a power supply unit.

Solution to Problem

In one embodiment, a light emitting diode (LED) lighting apparatus includes: an LED; a socket part supplying a power into the LED; a heat sink body having one side on which the LED is mounted and the other side to which the socket part is coupled; and a heat sink fin disposed along a circumference of the heat sink body, the heat sink fin having one side extending downward from the heat sink body.

Advantageous Effects of Invention

The LED lighting apparatus according to the current embodiment may be modified in shape to reduce a weight and improve the heat dissipation performance.

Also, the LED lighting apparatus may form the air layer between the socket part and the heat sink body to simultaneously and effectively absorb the heat generated in the power supply unit and the heat generated in the LED.

MODE FOR THE INVENTION

Hereinafter, exemplary embodiments will be described in detail with reference to the accompanying drawings.

Figure 1:
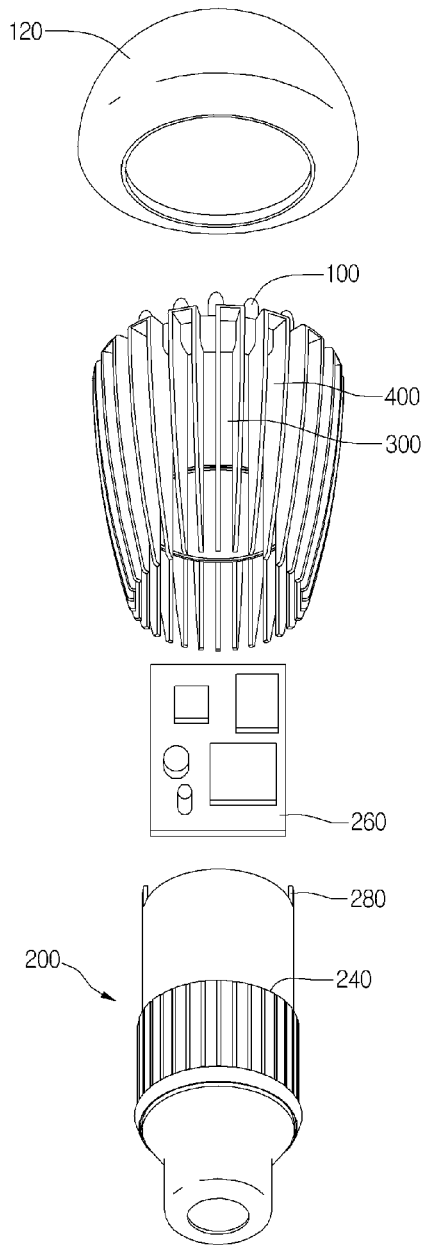
FIG. 1 is an exploded perspective view of an LED lighting apparatus according to an embodiment.
Figure 2:
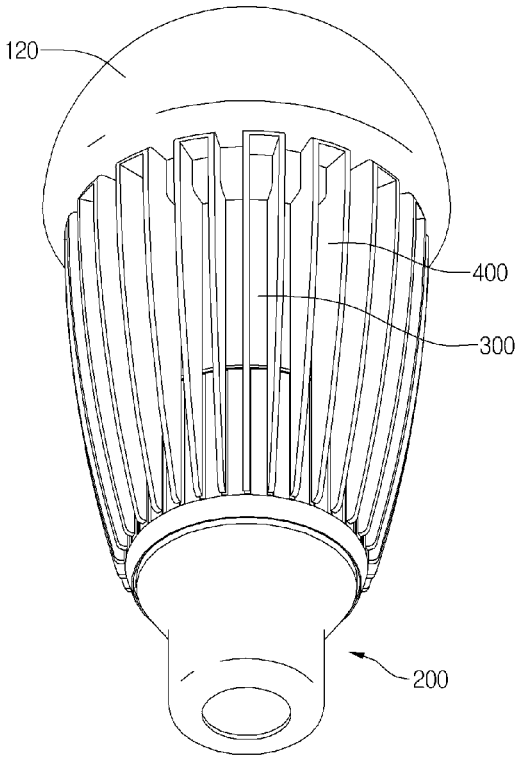
FIG. 2 is a perspective view of the assembled LED lighting apparatus according to an embodiment.
Figure 3:
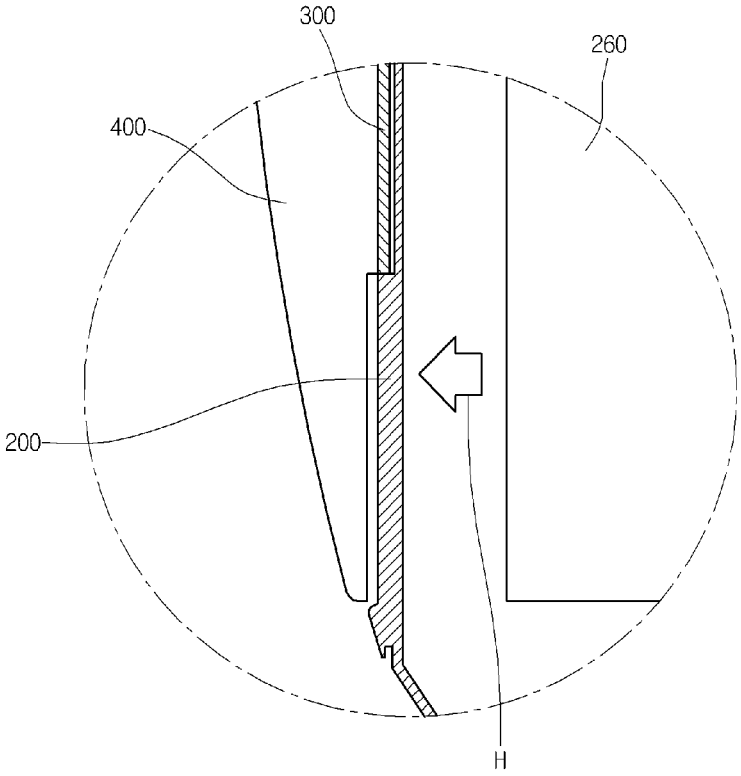
FIG. 3 is a sectional view illustrating a flow of heat generated in a power supply unit of the LED lighting apparatus according to an embodiment.
Figure 4:
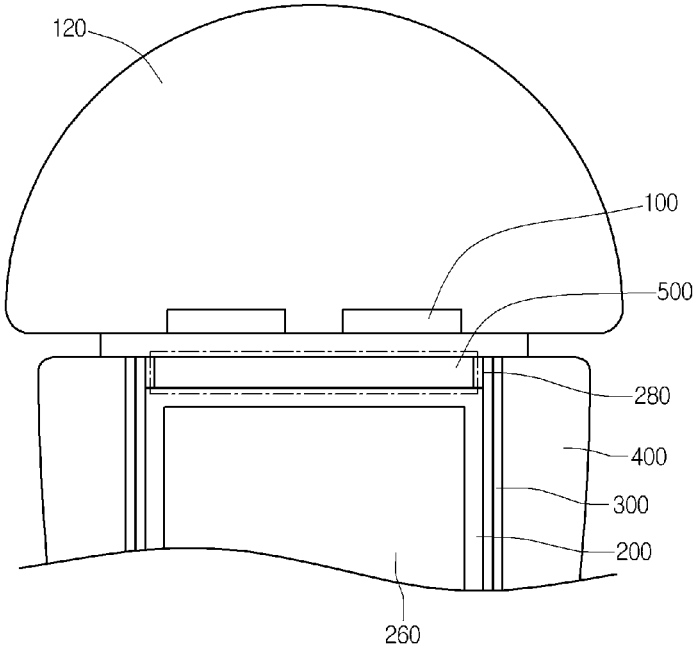
FIG. 4 is a partial sectional view of the LED lighting apparatus according to an embodiment.
Figure 5:
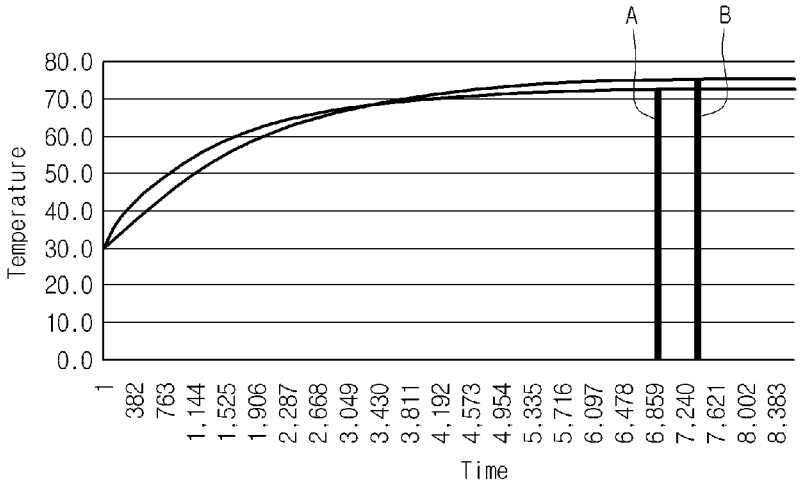
FIG. 5 is a sectional view illustrating a flow of heat generated in an LED and the power supply unit of the LED lighting apparatus according to an embodiment.
Figure 6:
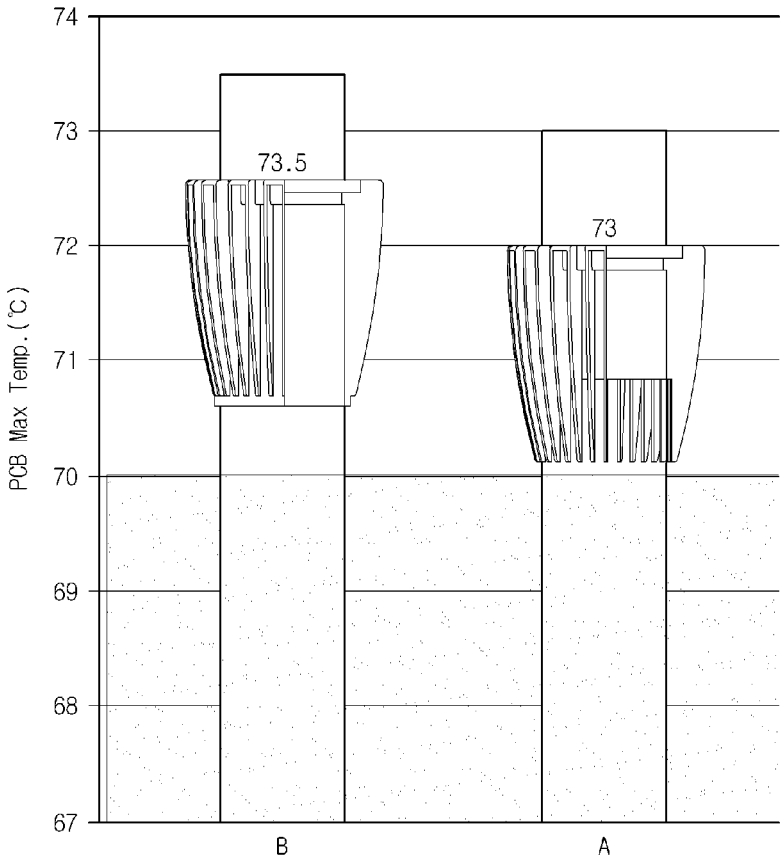
FIGS. 6 and 7 are perspective views illustrating a modified example of a protrusion of the LED lighting apparatus according to an embodiment.
Figure 7:
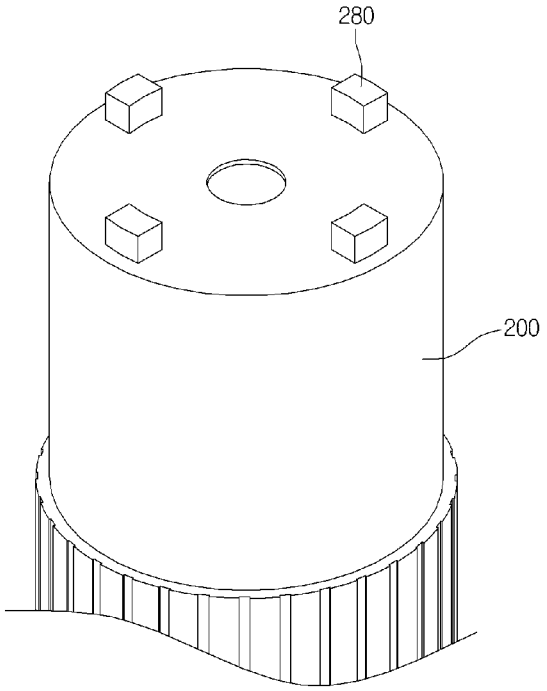
Figure 8:
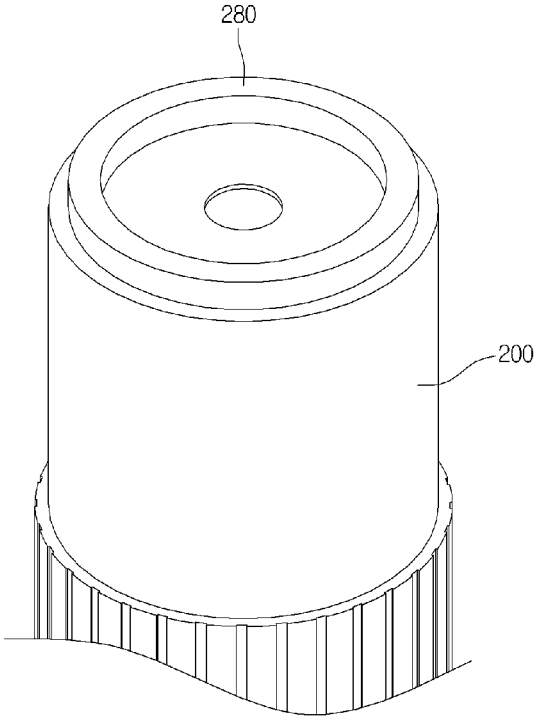
FIG. 8 is a comparison graph illustrating variation of a time taken to reach a light stabilization state of each of LED lighting apparatuses according to an embodiment and a related art.
Figure 9:
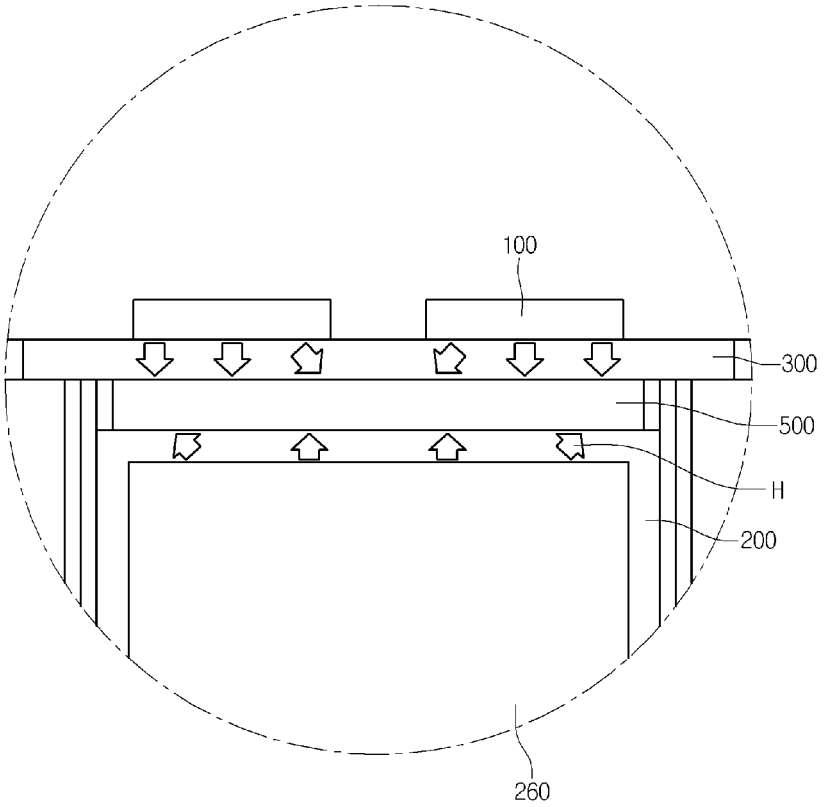
FIG. 9 is a comparison graph illustrating a temperature of each of LED lighting apparatuses according to an embodiment and a related art.

FIG. 1 is an exploded perspective view of an LED lighting apparatus according to an embodiment. FIG. 2 is a perspective view of an assembled LED lighting apparatus according to an embodiment. FIG. 3 is a sectional view illustrating a flow of heat generated in a power supply unit of the LED lighting apparatus according to an embodiment. FIG. 4 is a partial sectional view of the LED lighting apparatus according to an embodiment. FIG. 5 is a sectional view illustrating a flow of heat generated in an LED and the power supply unit of the LED lighting apparatus according to an embodiment. FIGS. 6 and 7 are perspective views illustrating a modified example of a protrusion of the LED lighting apparatus according to an embodiment. FIG. 8 is a comparison graph illustrating variation of a time taken to reach a light stabilization state of each of LED lighting apparatuses according to an embodiment and a related art. FIG. 9 is a comparison graph illustrating a temperature of each of LED lighting apparatuses according to an embodiment and a related art.

Referring to FIGS. 1 and 2, an LED lighting apparatus according to an embodiment includes an LED 100, a socket part 200 supplying power into the LED 100, a heat sink body 300 having one side on which the LED 100 is mounted and the other side to which the socket part 200 is coupled, and heat sink pins 400 disposed along a circumference of the heat sink body 300 and having one side extending to surround the outside of the socket part 200.

The LED 100 may include one of a red LED, a green LED, and a blue LED which can emit various colors or a combination thereof. Also, the LED 100 may be mounted on a printed circuit board (not shown).

The LED 100 may be mounted on one side of the heat sink body 300 that will be described in detail later. Also, a globe 120 may be further disposed on the one side on which the LED 100 is mounted to protect the LED 100.

The socket part 200 may have a cylindrical shape with a predetermined space therein. The socket part 200 may have a terminal shape so that one side of the socket part 200 is fitted into a receptacle buried in an existing ceiling surface.

A stepped portion 240 may be disposed along a circumference of a side surface of the socket part 200. The socket part 200 may be formed of a plastic resin to insulate parts received into the socket part 200 from each other.

A power supply unit 260 may be disposed within the socket part 200. The power supply unit 260 may be connected to the LED 100 to maintain constant voltage and current of a power applied through the socket part 200 and also constant intensity of light emitted from the LED 100.

Here, a predetermined hole (not shown) through which the power supply unit disposed within the socket part 200 is connected to the LED 100 may be defined in the other side of the socket part 200.

The heat sink body 300 may have a cylindrical shape with an inner space. The heat sink body 300 may be formed of a metallic material having superior formability and thermal conductivity. For example, the heat sink body 300 may be formed of aluminum among the metallic materials.

A separate mounting space for mounting the LED 100 may be defined in one side of the heat sink body 300. The other side of the heat sink body 300 may be opened. Also, an end of the other side of the heat sink body 300 may be seated on the stepped portion 240 disposed on the outside of the socket part 200.

Referring to FIG. 3, a portion including a front end of the socket part 200 may be disposed inside the heat sink body 300, and a remaining portion of the socket part 200 may be exposed to air.

Thus, heat H generated in the power supply unit 260 may be directly dissipated to the outside through a sidewall of the socket part 200. As a result, the LED lighting apparatus may have a relatively low thermal resistance to improve heat dissipation performance when compared to a LED lighting apparatus according to a related art in which heat is dissipated to the outside via a socket part, an air layer, and a heat sink body.

When power is supplied into the LED 100, heat is generated in the power supply unit 260 within the socket part 200, and then the heat generated in the power supply unit 260 is dissipated to the outside via the socket part 200.

That is, since a portion of the heat sink body surrounding the outside of the sock part according to the related art is removed, the structure according to the current embodiment may have a relatively low thermal resistance when compared to that of the structure according to the related art, thereby improving heat dissipation performance.

Also, since the heat sink body according to the current embodiment is significantly reduced in size than that according to the related art, the LED lighting apparatus according to the current embodiment may be reduced in weight and cost.

The heat sink pin 400 may be disposed outside the heat sink body 300. The heat sink pins 400 may be radially disposed along the circumference of the heat sink body 300. Also,the heat sink pins 400 may be spaced a predetermined distance from each other on the outside of the heat sink body 300. Each of the heat sink pins 400 may have a wing shape having an upper width greater than a lower width.

The heat sink fin 400 may have a length greater than that of the heat sink body 300 in a length direction to surround the outside of the socket part 200. Thus, the heat sink body 300 may have a length less than about ½ of that of the heat sink fin 400. The heat sink fin 400 may be formed of the same material as the heat sink body 300. Also, the heat sink fin 400 and the heat sink body 300 may be integrally manufactured through extrusion, die casting, or forging. Alternatively, the heat sink fin 400 may be additionally jointed to the heat sink body 300 after the heat sink body 300 is manufactured. A method of jointing the heat sink fin 400 to the heat sink body 300 may include a brazing, soldering, or welding method.

Although the heat sink fin 400 has the wing shape, the present disclosure is not limited thereto. For example, the heat sink fin 400 may have a polygonal or oval shape. Also, the heat sink fin 400 may be varied in thickness, height, and distance to improve the heat dissipation effect.

As described above, since the heat sink fin 400 has the wing shape with a wide width and is sufficiently elongated in length, the heat generated from the Led 100 may be sufficiently absorbed to improve heat dissipation performance.

Referring again to FIG. 1, protrusions 280 may be further disposed on the front end of the socket part 200 to effectively dissipate the heat generated in the power supply unit 260. The protrusions 280 may be disposed at a certain distance on the front end of the socket part 200 and have various shapes.

Referring to FIG. 4, when the socket part 200 is coupled to the heat sink body 300, the protrusions 280 may be disposed between the front end of the socket part 200 and an inner surface of the heat sink body 300 facing the front end of the socket part 200. Thus, an air layer 500 may be formed between the front end of the socket part 200 and the inner surface of the heat sink body 300. The air layer 500 may be a medium which can reduce a temperature of heat and effectively absorb heat generated from the power supply unit 260. Also, the air layer 500 may effectively absorb heat generated from the LED 100 mounted on one side of the heat sink body 300 to maximize the heat dissipation effect.

That is, referring to FIG. 5, the heat H generated in the Led 100 may be absorbed into the air layer 500 formed between the socket part 200 and the heat sink body 300 to prevent the heat H from being transferred into the socket part 200.

As described above, the heat H generated in the power supply unit 260 may be absorbed also into the air layer 500 formed between the socket part 200 and the heat sink body 300 to prevent the heat H from being transferred into the heat sink body 200.

The air layer 200 may isolate the two heat sources from each other to minimize an effect due to the heats H therebetween, thereby maximizing the heat dissipation performance.

Although the protrusions 280 are disposed on both facing sides of the front end of the socket part 200, the present disclosure is not limited thereto. For example, the protrusions 280 may be provided with a shape as shown in FIGS. 6 and 7.

Referring to FIG. 6, a protrusion 280 may be provided in plurality on the front end of the socket part 200. The plurality of protrusions 280 may be spaced from each other on a concentric circle.

The protrusions 280 may minimize an area on which the socket part 200 and the heat sink body 300 contact each other when the socket part 200 and the heat sink body 300 are coupled to each other. Also, the socket part 200 may be stably supported on the heat sink body 300 by the protrusions 280.

Here, each of the protrusions 280 may have a polygonal pillar having a triangular or pentagonal shape. Alternatively, each of the protrusions 280 may have a circular or oval pillar shape.

Referring to FIG. 7, a protrusion 280 may have a close loop shape on the front end of the socket part 200, e.g., a ring shape.

The protrusion 280 may stably form an air layer therein when the socket part 200 and the heat sink body 300 are coupled to each other to prevent heat from be introduced into the air layer from the outside of the protrusion 280.

Although the protrusion 280 has the ring shape, the present disclosure is not limited thereto. For example, the protrusion 280 may have a triangular or square shape defining a close loop. Although the protrusion 280 is disposed on the front end of the socket part 200, the present disclosure is not limited thereto. For example, the protrusion 280 may be disposed on an inner surface of the heat sink body 300 facing the front end of the socket part 200.

Also, although the protrusion 280 is disposed on one of the socket part 200 and the inner surface of the heat sink body 300, the present disclosure is not limited thereto. For example, protrusions 280 may be disposed on all of the socket part 200 and the inner surface of the heat sink body 300.

Also, when the protrusions 280 are disposed on all of the socket part 200 and the inner surface of the heat sink body 300, the two protrusions may be modified in shape so that the two protrusions are coupled to each other.

Referring to FIG. 8, when a light stabilization state of the LED lighting apparatus according to the current embodiment is measured, it may be seen that an LED lighting apparatus A according to the current embodiment is stabilized faster by about 8% than that of an LED lighting apparatus B according to the related art.

Also, referring to FIG. 9, in the heat dissipation performance of the LED lighting apparatus according to the current embodiment, it may be seen that the LED of the LED lighting apparatus A according to the current embodiment has a temperature less by about 0.5° than that of the LED of the LED lighting apparatus B according to the related art to improve heat dissipation performance for all that the heat sink body is removed in shape.

As described above, the LED lighting apparatus according to the current embodiment may be modified in shape to reduce a weight and improve heat dissipation performance.

Also, the LED lighting apparatus according to the current embodiment may form the air layer 500 between the socket part 200 and the heat sink body 300 to simultaneously and effectively absorb the heat generated in the power supply unit 260 and the heat generated in the LED 100.

It will be apparent to those skilled in the art that various modifications and variations can be made in the present disclosure. Thus, it is intended that the present disclosure covers the modifications and variations of this invention provided they come within the scope of the appended claims and their equivalents.

The invention claimed is:

1. A light emitting diode (LED) lighting apparatus comprising:

an LED;

a socket part supplying a power into the LED;

a heat sink body having one side on which the LED is mounted and the other side to which the socket part is coupled; and a heat sink fin disposed along a circumference of the heat sink body, the heat sink fin having one side extending downward from the heat sink body, wherein an air layer is formed between the socket part and the heat sink body.

2. The LED lighting apparatus according to claim 1, wherein the one side of the heat sink pin extending downward from the heat sink body is disposed outside the socket part.

3. The LED lighting apparatus according to claim 2, wherein a stepped portion is disposed outside the socket part, and an end of the heat sink body is disposed on the stepped portion.

4. The LED lighting apparatus according to claim 2, wherein a protrusion for forming the air layer is disposed on one of a front end of the socket part and an inner surface of the heat sink body facing the front end of the socket part.

5. The LED lighting apparatus according to claim 4, wherein the protrusion is provided in plurality and the plurality of protrusions are spaced a predetermined distance from each other, or the protrusion has a ring shape.

6. The LED lighting apparatus according to claim 1, wherein the heat sink body has a length less than about ½ of that of the heat sink fin.

7. The LED lighting apparatus according to claim 1, wherein the heat sink fin has a wing shape, a polygonal shape, or an oval shape.

8. The LED lighting apparatus according to claim 1, wherein a power supply unit is further disposed within the socket part.

9. A light emitting diode (LED) lighting apparatus comprising:

a heat sink body;

an LED mounted on one side of the heat sink body; and a socket part coupled to the other side of the heat sink body, the socket part having an end spaced from an inner surface of the heat sink body;

wherein a protrusion is disposed on one of the end of the socket part and the inner surface of the heat sink body facing the end of the socket part.

10. The LED lighting apparatus according to claim 9, wherein the protrusion forms a closed loop.

11. The LED lighting apparatus according to claim 9, wherein the protrusion is divided into plurality along a concentric circle.

* * * * *